US008060954B2

(12) United States Patent
Antunez

(10) Patent No.: US 8,060,954 B2
(45) Date of Patent: Nov. 22, 2011

(54) TOILET FLUSH ACTUATOR DEVICE

(76) Inventor: Bruce A. Antunez, Glendora, CA (US)

( * ) Notice: Subject to any disclaimer, the term of this patent is extended or adjusted under 35 U.S.C. 154(b) by 456 days.

(21) Appl. No.: 12/378,352

(22) Filed: Feb. 13, 2009

(65) Prior Publication Data

US 2010/0205735 A1 Aug. 19, 2010

(51) Int. Cl.
*E03D 5/09* (2006.01)

(52) U.S. Cl. ..... 4/412; 4/390; 4/405

(58) Field of Classification Search ..... 4/378, 395–397, 4/405, 411–414
See application file for complete search history.

(56) References Cited

U.S. PATENT DOCUMENTS 3,339,211 A * 9/1967 Wills ..... 4/413
4,435,859 A * 3/1984 Barnowski ..... 4/324
4,604,763 A * 8/1986 Sprang ..... 4/391
7,200,877 B2 * 4/2007 Peng ..... 4/325
* cited by examiner

*Primary Examiner* — Charles Phillips
(74) *Attorney, Agent, or Firm* — Frederick Gotha

(57) ABSTRACT

The invention relates to a toilet flush actuator mechanism for a toilet tank which has a discharge port surrounded by a valve seat having a central axis, a ball-cock type valve, and a flush valve having a vertical axis. The actuator mechanism consists of a trip lever pivotally mounted to the toilet tank and having a free end over which a boot member is telescopically and captively held. First and second resilient guide members extend laterally from the boot member adjacent the free end, and are parallel, coplanar, and separated by a fixed distance. A linkage member is captively carried in fixed relationship with the upper end of the flush valve and has an open void region through which the free end extends. This permits a slidable bearing relationship between the linkage member and the boot member intermediate the first and second resilient guide members as the trip lever pivots upwardly to lift the flush valve thereby retaining the co-axial alignment of the vertical axis of the flush valve and the central axis of the valve seat.

15 Claims, 3 Drawing Sheets

TOILET FLUSH ACTUATOR DEVICE

FIELD OF THE INVENTION

This invention relates to toilet tank flush valve actuators for lifting the flush valve from a valve seat to initiate discharge water flow into the toilet bowl.

BACKGROUND OF THE INVENTION

Trip levers used to lift flush valves are well known in the prior art. Plunger valves and flapper type flush valves are examples of early type flush valves where a chain was connected directly from the trip lever to the valve for lifting it from the valve seat to initiate water flow from the toilet tank into the bowl. Twisting of the chain in many instances during the flush sequence caused the flush valve to improperly seat and consequently there would be a continuous discharge of water into the toilet bowl. To remedy the resulting "running toilet" problem, an adjustment to the chain was necessary to permit the valve to properly seat. Both plunger and flapper type flush valves, although still extensively used, and in addition to chain interference with seating of the flush valve, have the environmental problem of reliably controlling the amount of water or size of a flush on a consistent basis. This has led to new and improved valves or closure bodies to initiate flushing where the closure body or flush valve may be, for example, a hollow body having a vertical axis co-axial with the central axis of the valve seat and directly linked to the trip lever. The linkage between the trip lever and hollow body, however, upon actuation of the trip lever has been unreliable in assuring that throughout the flush sequence that the vertical axis of the body would remain co-axial with the central axis of the valve seat; misalignment of these axes upon closure of the flush valve would result in an imperfect seal resulting in a "running toilet".

It would therefore be desirable to provide a direct linkage mechanism for lifting the flush valve so as to retain co-axial alignment during the flush sequence of the vertical axis of the flush valve and the valve seat central axis so as to assure a proper seal upon the seating of the flush valve body.

SUMMARY OF THE INVENTION

It is therefore an object of this invention to provide a toilet flush actuator mechanism that links the trip lever to the flush valve such that the vertical axis of the flush valve and the central axis of the valve seat remain substantially co-axial during the toilet flush sequence.

This invention relates to a toilet flush actuator mechanism for a toilet tank of the type having a valve seat surrounding the discharge port of the tank and a flush valve that is lifted from the valve seat to initiate the toilet flush. To lift the flush valve from the valve seat, the actuator mechanism of this invention incorporates a rigid trip lever having a first end that is pivotally mounted to the toilet tank, a free end opposite said first end forming a terminus of the trip lever, and an axis of elongation. Adjacent the free end of the trip lever a first resilient guide member is carried in fixed relationship with the trip lever and extends laterally and upwardly from said axis of elongation. A second resilient guide member is carried by the trip lever in fixed relationship therewith and located a predetermined axial distance from the first resilient guide member and intermediate the first resilient guide member and the first end of the trip lever. The second guide member is substantially parallel to and co-planar with the first resilient guide member.

The trip lever is so mounted pivotally to the toilet tank that by depressing the first end of the trip lever, the free end of the trip lever will be rotated upwards in an arcuate path causing an increase in the axial slope of the free end portion of the trip lever. As the free end of the trip lever rotates upwardly, a linkage member which may be a u-shaped frame is carried by the flush valve adjacent its upper-end, and bears in compressive engagement against the trip lever as it rotates upwardly. The linkage member is carried in fixed relationship with the flush valve and has an open void region and a peripheral surface where the open void region is bounded at least in part by the peripheral surface. The free end of the trip lever extends telescopically through the open void region to permit relative slidable movement with respect to an engagement portion of the peripheral surface where the engagement portion extends laterally from the flush valve adjacent its upper end and is interposed between the first and second resilient guide members for slidable bearing engagement with the trip lever. Thus, when the trip lever is sufficiently depressed, the engagement portion will compressively bear in slidable relationship against the increasing slope of the free end of the trip lever as the free end moves upwardly thereby lifting the flush valve from the valve seat. As the free end continues to move upwardly, the free end remains in slidable bearing engagement with the engagement portion of the peripheral surface between the first and second guide members thereby retaining the co-axial alignment of the vertical axis of the flush valve and the central axis of the valve seat throughout the flush sequence.

In the preferred but optional embodiment of the invention, the linkage member consists of a cylindrical cap having a u-shaped frame extending laterally from the cap where the cap is removably mounted and captively held by the flush valve at its upper end; the u-shaped frame having an upper laterally extending arm that contains the engagement portion of the peripheral surface, a vertical arm, and a lower laterally extending arm which collectively form the peripheral surface bounding the void region.

BRIEF DESCRIPTION OF THE DRAWINGS

These and other features and advantages will become appreciated as the same become better understood with reference to the following specification, claims and drawings where:

DETAILED DESCRIPTION

Figure 1:
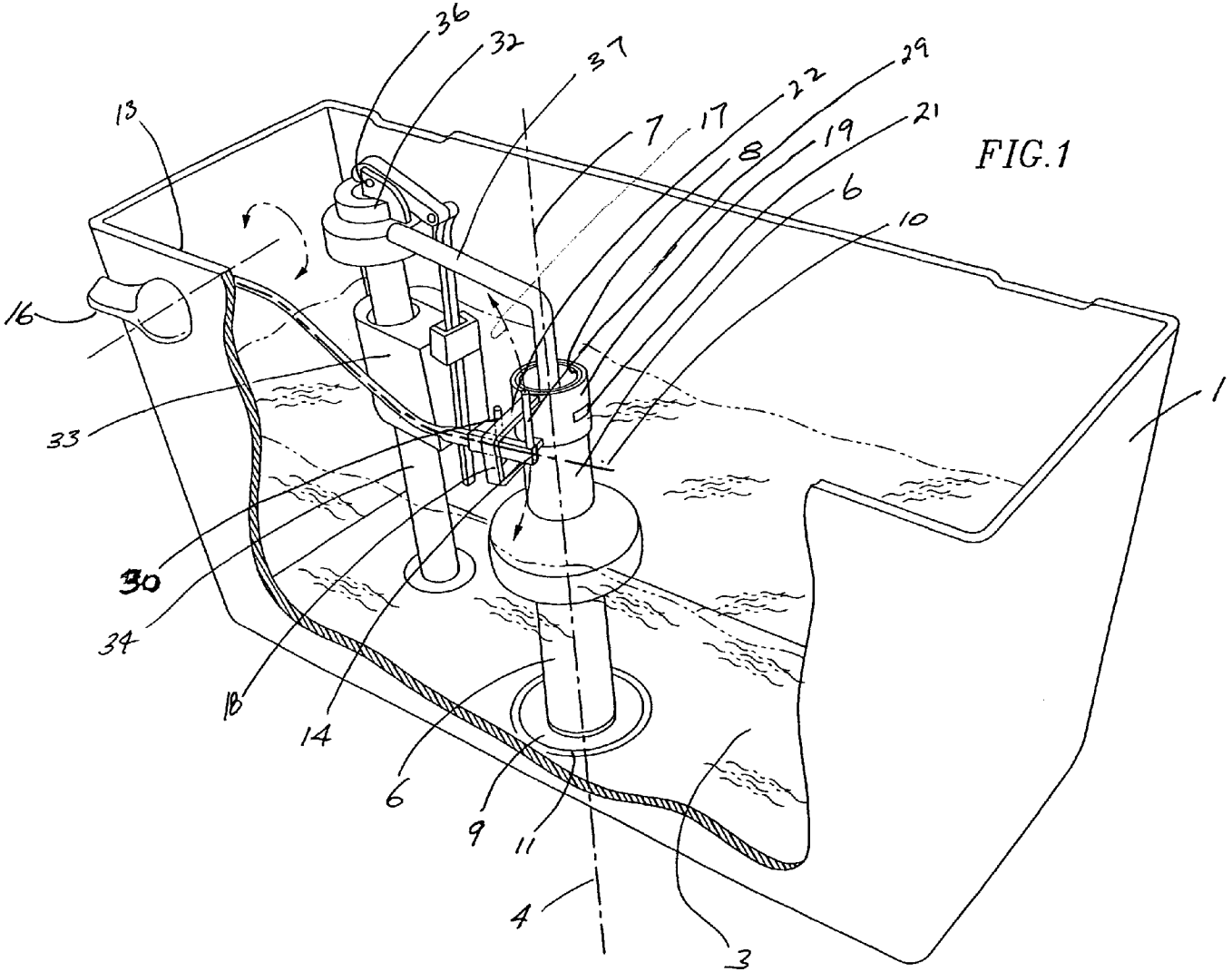
FIG. 1 is a perspective view in part cutaway cross-section of a toilet tank installation illustrating the seated flush valve and the actuator mechanism of this invention.
Figure 2:
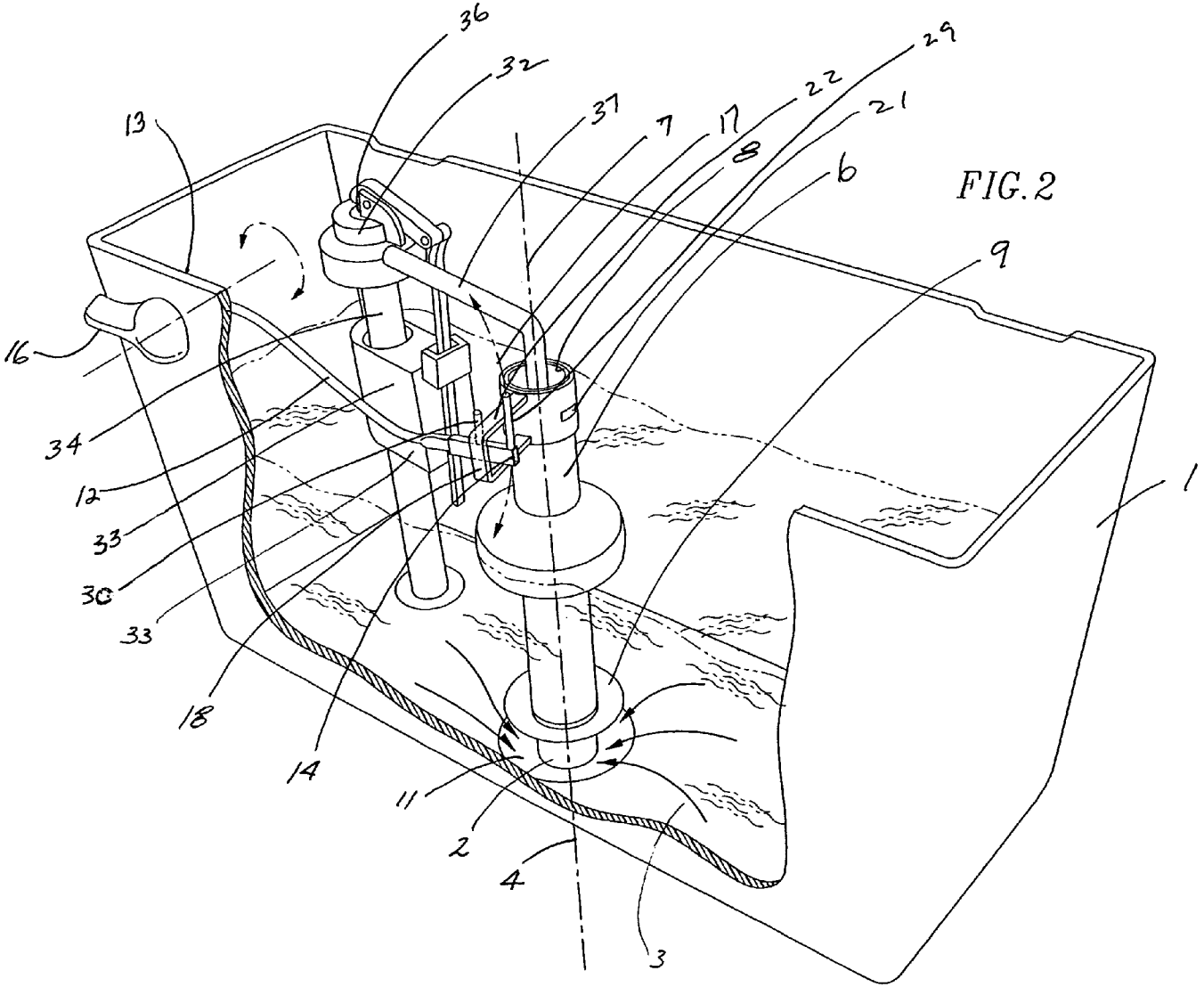
FIG. 2 is a perspective view in part cutaway cross-section of the toilet tank installation of FIG. 1 illustrating the unseated flush valve and the actuator mechanism of this invention during a toilet flush.

By referring to FIG. 1 which is a perspective view in part cutaway cross-section of toilet tank 1, the various elements comprising the toilet tank installation are illustrated in a pre-flush configuration. FIG. 2, which is also a perspective view in part cutaway cross-section, illustrates the initiation of the flush sequence as the discharge port 2 of toilet tank 1 is opened thereby permitting the flush water 3 to discharge into the toilet bowl (not shown). Discharge port 2 is surrounded by valve seat 11 that has a central axis 4 that extends vertically and passes through the approximate geometrical center of the discharge port opening.

Referring again to FIG. 1, it can be seen that flush valve 6, which is preferably hollow, has a vertical axis 7 that is substantially co-axial with central axis 4. Flush valve 6 has an upper-end 8 and carries a circumferential seal 9 which in the pre-flush configuration as shown in FIG. 1 is seated in valve seat 11.

This invention relates to an actuator mechanism that so lifts flush valve 6 from the valve seat 11, that vertical axis 7 of flush valve 6 remains substantially co-axial with central axis 4 of valve seat 11 throughout the flush sequence. The actuator mechanism of this invention hereafter described preserves the co-axial alignment of the flush valve axis and the central axis of the valve seat during the lifting and descending of flush valve 6 which permits the flush valve to be reliably seated in valve-seat 11 after each flush thereby substantially reducing the "running toilet" problem.

Figure 5:
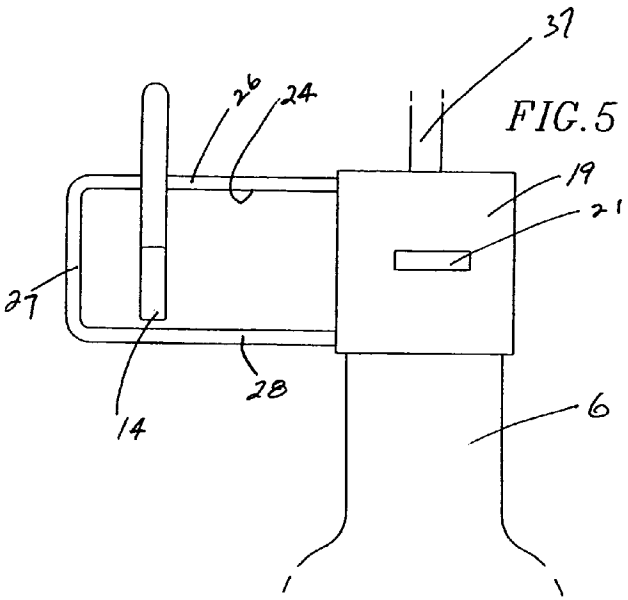
FIG. 5 is an isolated front view of the actuator mechanism of this invention illustrating the linkage member void region bounded by a peripheral surface.
Figure 3:
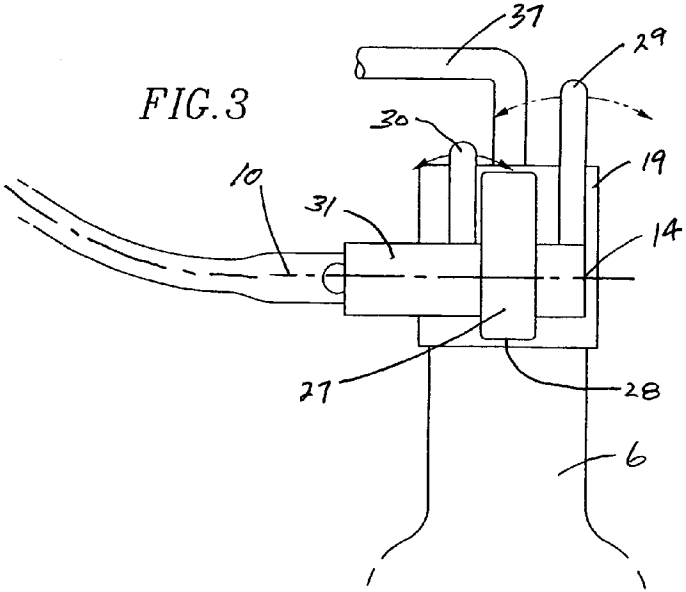
FIG. 3 is an isolated side view of the actuator mechanism of this invention.

The actuator mechanism is comprised of a rigid trip lever 12 that has an axis of elongation 10, a first end 13 and a free-end 14. First-end 13 is rotationally fixed to toilet lever 16 by a lock-nut (not shown) that is fastened to the toilet lever from inside toilet tank 1. Thus, trip lever 12 is pivotally mounted to toilet tank 1 at its first-end 13; and, as can be seen by referring to FIGS. 1 and 2, when toilet lever 16 is pushed downward, free-end 14 moves upwardly in an arcuate path 17 and the slope of the axis of elongation 10 with respect to the horizontal increases. The actuator mechanism is further comprised of a linkage member 18 which is illustrated in FIGS. 1, 2, 3 and 5 and in a preferred embodiment consists of a removably mounted cap 19 that is captively held by flush valve 6 at its upper end 8 by flexible coupling 21. A unshaped frame 22 extends laterally of cylindrical cap 19 where the frame bounds void region 23 by upper engagement surface 24 of laterally extending upper arm 26 as can be seen in FIG. 5. By again referring to FIG. 5, it can further be seen that u-shaped frame 22 has a vertical arm 27 and a lower laterally extending arm 28 which along with upper extending arm 26 collectively enclose void region 23. By referring to FIGS. 1, 2, and 3, it can be seen that free-end 14 of trip lever 12 extends through void region 23 in slidable telescopic relationship therewith which permits relative movement of free-end 14 with respect to u-shape frame 22 within the void region.

Figure 4:
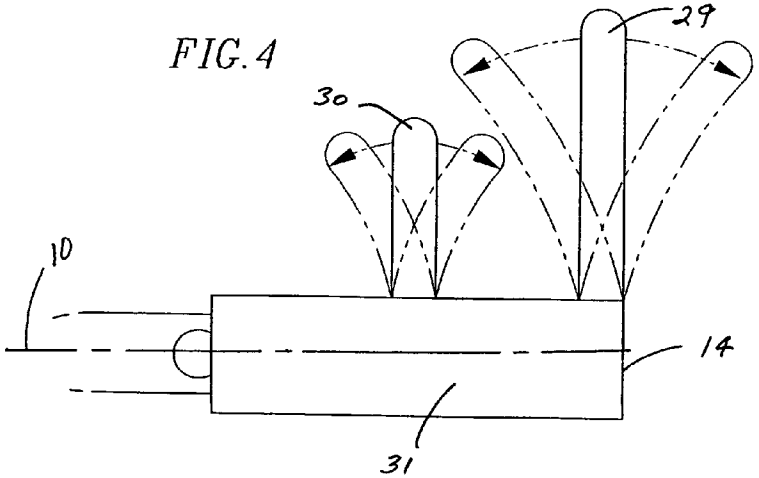
FIG. 4 is an isolated side view of the actuator mechanism of this invention illustrating the resiliency of the first and second guide members of the actuator mechanism.

Adjacent free-end 14 and extending substantially orthogonally from axis of elongation 10, a first resilient guide member 29 is carried in a fixed relationship with trip lever 12. At a pre-determined axial distance from first resilient guide member 29, a second resilient guide member 30 extends substantially orthogonally from axis of elongation 10 where the first and second guide members are substantially parallel in a vertical plane and coplanar. In the preferred embodiment, a boot member 31 is carried in a fixed relationship adjacent the free end 14 and so carries first and second resilient guide embers 29 and 30 such that they extend substantially parallel and co-planar in a vertical plane from boot member 31. The resiliency of guide members 29 and 30 is illustrated in FIG. 4.

By referring to FIGS. 1 and 2, a toilet flush actuated by the actuator mechanism of this invention will be described. The toilet tank installation shown in FIGS. 1 and 2 contains a refill valve 32 which is responsive to the water level in the toilet tank and incorporates a ball cock valve 36 of the type well known in the prior art. The ball cock valve is closed when the water level is at a predetermined height and open when below that height. The opening and closing of the ball cock valve is controlled by float 33 which is guided vertically by riser 34. When ball cock valve 36 is open, water is discharged through re-fill tube 37 into the toilet tank where it continues to discharge until float 33 ascends vertically and reaches the closure water level of the toilet tank. Thus, the time flush valve 6 remains unseated after it is lifted from valve seat 11 determines the quantity of water or flush quantity that will be discharged through discharge port 2. To assure that the vertical axis of flush valve 6 remains in co-axial alignment with the central axis of the discharge port to properly seat and seal against valve seat 11, the free end 14 of trip lever 12 extends telescopically through void region 23. When the toilet lever 16 is tripped downwardly to initiate the flush, the free end 14 moves upward on an arcuate path within the void region. As the free end ascends upwardly, it will bearingly engage upper engagement surface 24 of u-shaped frame 22 and as toilet lever 16 is further displaced downwardly, lift flush valve 6 from the valve seat. Engagement surface 24 of laterally extending arm 26 is captively but slidably contained between first and second resilient guide members 29 and 30. The limited slidable movement of the captively restricted engagement surface between the first and second guide members retains the co-axial alignment between the vertical axis of the flush valve and the central axis of the discharge port substantially assuring that the flush valve circumferential seal 9 will seal the discharge port.

This invention is not be limited by the embodiment shown in the drawings and described in the description, which is given by way of example and not of limitation, but only in accordance with the scope of the appended claims.

What is claimed is:

1. A toilet flush actuator mechanism for a toilet tank which has a valve seat surrounding a discharge port having a central axis and a flush valve, said flush valve for opening and closing the valve seat and having a vertical axis, comprising:

(a) a rigid trip lever having an axis of elongation, a first end pivotally carried by said toilet tank, and a free end;

(b) a first resilient guide member carried by said trip lever adjacent said free end and extending laterally therefrom;

(c) a second resilient guide member carried by said trip lever intermediate said free end and said first end at a pre determined distance from said free end, where said second resilient guide member is substantially parallel to and co-planar with said first resilient guide member; and (d) a linkage member carried by said flush valve adjacent said upper end of said flush valve and in fixed relationship therewith, said linkage member having an open void region and a peripheral surface where said open void region is bounded at least in part by said peripheral surface and where said free end extends telescopically through said open void region and where said peripheral surface comprises an engagement portion interposed between said first and second resilient guide members for slidable bearing engagement relative thereto such that upon sufficient rotation of said trip lever, said engagement surface will compressibly bear against said trip lever thereby vertically displacing said flush valve from said valve seat.

2. The toilet flush actuator mechanism recited in claim 1 where said linkage member comprises a laterally extending upper arm containing said engagement portion, said engagement portion defining at least in part a boundary of said open void region.

3. The toilet flush actuator mechanism recited in claim 1, where said linkage member compromises a u-shaped frame having an upper arm extending laterally from said vertical axis, said upper arm containing said engagement portion, a vertical arm, and a lower arm where said upper arm, said lower arm, and said vertical arm collectively form a boundary at least in part of said open void region.

4. The toilet flush actuator mechanism recited in claim 1 where said linkage member comprises a cylindrical cap captively carried by said flush valve where said cylinder cap has a u-shaped frame having a laterally extending upper arm from said vertical axis containing said engagement portion.

5. The toilet flush actuator mechanism recited in claim 4 where said u-shaped frame further comprises a vertical arm and a lower laterally extending arm where said upper arm, said lower arm, and said vertical arm collectively bound in part said open void region.

6. A toilet flush actuator mechanism for a toilet tank which has a valve seat surrounding a discharge port having a central axis and a flush valve, said flush valve for opening and closing the valve seat and having a vertical axis, comprising:

(a) a rigid trip lever having an axis of elongation, a first end pivotally carried by said toilet tank, and a free end;

(b) a boot means removably and captively carried by said rigid trip lever adjacent said free end for guiding vertical axial displacement of said flush valve;

(c) a first resilient guide member carried by said boot means and extending laterally therefrom adjacent said free end;

(d) a second resilient guide member carried by said boot means a pre-determined distance from said first resilient guide member where said second resilient guide member is substantially parallel to and co-planar with said first resilient guide member; and (e) linkage means carried by said flush valve adjacent said upper end and in fixed relationship therewith for slidable bearing engagement with said trip lever intermediate said first and second resilient guide members such that said vertical axis of said flush valve and said central axis are substantially co-axial during vertical axial displacement of said flush valve.

7. The toilet flush actuator mechanism recited in claim 6 where said linkage means comprises a u-shaped frame having an open void region where said free end of said trip lever extends telescopically through said open region.

8. The toilet flush actuator mechanism recited in claim 7 where said u-shaped frame comprises an upper arm extending laterally said vertical axis and having an engagement surface that bounds said open void region.

9. The toilet flush actuator mechanism recited in claim 8 where said u-shaped frame further comprises a vertical arm and a lower arm extending laterally said vertical axis, where said upper arm, said lower arm and said vertical arm collectively define at least in part a boundary of said open void region.

10. The toilet flush actuator mechanism recited in claim 6 where said linkage means comprises a cylindrical cap captively carried by said flush valve, said cylindrical cap having a u-shaped frame defining at least in part a boundary of said open void region and where said free end of said trip lever extends telescopically through said open void region.

11. In combination:

(a) a toilet tank which has a valve seat surrounding a discharge port having a central axis and a flush valve, said flush valve for opening and closing the valve seat. Said flush valve having a vertical axis;

(b) a toilet flush actuator comprising a rigid trip lever having an axis of elongation, a first end pivotally carried by said toilet tank, and a free end, a boot member removably and captively carried by said rigid trip lever adjacent said free end for guiding vertical axial displacement of said flush valve, a first resilient guide member carried by said boot member and extending laterally therefrom adjacent said free end, a second resilient guide member carried by said boot member a pre-determined distance from said first resilient guide member where said second resilient guide member is substantially parallel to and co-planar with said first resilient guide member, and linkage means carried by said flush valve adjacent said upper end and in fixed relationship therewith for slidable bearing engagement with said trip lever intermediate said first and second resilient guide members such that said vertical axis of said flush valve and said central axis are substantially co-axial during vertical axial displacement of said flush valve.

12. The combination recited in claim 11 where said linkage means comprises a u-shaped frame having an open void region where said free end of said trip lever extends telescopically through said open void region.

13. The combination recited in claim 12 where said u-shaped frame comprises an upper arm extending laterally said vertical axis and having an engagement surface that bounds said open void region.

14. The combination recited in claim 13 where said u-shaped frame further comprises a vertical arm and a lower arm extending laterally said vertical axis, where said upper arm, said lower arm and said vertical arm collectively define at least in part a boundary of said open void region.

15. The combination recited in claim 11 where said linkage means comprises a cylindrical cap captively carried by said flush valve, said cylindrical cap having a u-shaped frame defining at least in part a boundary of said open void region and where said free end of said trip lever extends telescopically through said open void region.

* * * * *